United States Patent [19]

Akagi et al.

[11] Patent Number: 4,522,873

[45] Date of Patent: Jun. 11, 1985

[54] FIBROUS STRUCTURE HAVING ROUGHENED SURFACE

[75] Inventors: Takao Akagi; Shinji Yamaguchi, both of Kurashiki; Akira Kubotsu, Soja, all of Japan

[73] Assignee: Kuraray Co., Ltd., Kurashiki, Japan

[21] Appl. No.: 584,331

[22] Filed: Feb. 28, 1984

[30] Foreign Application Priority Data

| | | | |
|---|---|---|---|
| Feb. 28, 1983 | [JP] | Japan | 58-33301 |
| Apr. 15, 1983 | [JP] | Japan | 58-67511 |
| May 16, 1983 | [JP] | Japan | 58-86250 |

[51] Int. Cl.[3] ..... B32B 5/16

[52] U.S. Cl. ..... 428/283; 428/240; 428/241; 428/253; 428/372; 428/400; 428/402; 428/409

[58] Field of Search ..... 428/240, 241, 283, 372, 428/400, 402, 409, 253

[56] References Cited

U.S. PATENT DOCUMENTS

| | | | |
|---|---|---|---|
| 4,177,312 | 12/1979 | Rosen et al. | 428/296 |
| 4,254,182 | 3/1981 | Yamaguchi et al. | 428/372 |
| 4,451,534 | 5/1984 | Akagi et al. | 428/372 |
| 4,468,434 | 8/1984 | Sekimoto et al. | 428/372 |

*Primary Examiner*—James J. Bell

*Attorney, Agent, or Firm*—Kramer and Brufsky

[57] ABSTRACT

A fibrous structure having a roughened surface and a process for producing the same are disclosed. Upon dying, the fibrous structure is greatly improved in color depth. In addition, it gives one a more scrooping feeling than silk does.

The fibrous structure has surface irregularities whose structure is such that the distance between the adjacent projections is 0.01 to 0.7 micrometer and the area of the concave portions is 0.1 to 0.8 square micrometer in 1 square micrometer of the irregularities.

The fibrous structure is produced by the steps of attaching fine particles to the fiber surface in an amount of 0.001 to 10 wt % based on the fiber, said fine particles having an average primary particle diameter smaller than 0.5 micrometer and being more inert than the fiber-constituting polymer base material to low-temperature plasma, and subjecting the fiber, to which said fine particles have been attached, to low-temperature plasma, thereby forming projections which are larger than the average primary particle diameter.

2 Claims, 2 Drawing Figures

FIBROUS STRUCTURE HAVING ROUGHENED SURFACE

BACKGROUND OF THE INVENTION

1. Field of the Invention

The present invention relates to a fibrous structure having a roughened surface and to a process for producing the same. Upon dyeing, the fibrous structure is greatly improved in color depth. In addition, it gives one a more scrooping feeling than silk does.

2. Description of the Prior Art

A variety of processes have been proposed for improving the color depth and hand of fabrics. So far, no satisfactory technology has been developed which can be applied to all kinds of fibers and produce satisfactory color, hand, and function without the loss of performance.

Natural fibers characteristicly exhibit good moisture absorption but poor dimensional and form stability. Moreover, such fibers are poor in color when dyed as compared with natural brilliant colors of flowers and insects. On the other hand, organic synthetic fibers, especially those which are made by melt spinning, disadvantageously exhibit a peculiar waxy feeling and gloss which comes from the excessive smoothness of the fiber surface and also exhibit poor color development upon dyeing. In addition, such fibers generate static charge and are somewhat inferior in hand to natural fibers.

The above-mentioned disadvantages are usually attributable to the nature of the surface of the fiber. Therefore, efforts have been made to overcome such disadvantages by roughening the fiber surface, without changing the fundamental properties of the fiber, by using fine particles and low-temperature plasma treatment.

It is believed that the luster can be improved and the hand changed by roughening the surface of fibers. Based on this belief, it is common practice to deluster fibers by adding fine particles such as titanium oxide to fibers. However, it is known that while such a process delusters the fabric, it detracts from the color of the fabric. Color, particularly color depth and brilliance, are important requirements for fibers, no matter where the fibers are used.

Although polyester fibers are in general use because of their outstanding properties, they are still plagued by unsolved problems concerning color development. There is a strong demand for polyesters which are superior in color depth and brilliance.

In order to solve these problems, several techniques have been proposed.

The present inventors had previously disclosed in U.S. Pat. No. 4,254,182 and British Pat. No. 2,016,364 a technique for producing a color deepening effect by etching the surface of polyester fibers containing minute inorganic particles with an alkali so that irregularities are formed on the fiber surface.

According to Japanese Pat. Laid-open No. 99400/1977, a color deepening effect is produced by treating an organic synthetic fiber with glow discharge plasma so that irregularities are formed on the fiber surface.

Although the processes disclosed in U.S. Pat. No. 4,254,182 and U.K. No. 2,016,364 can produce a superior color deepening effect which previously had never been achieved with conventional polyester fibers, such processes still have the disadvantage that the resulting polyester decreases in luster; in other words, it is difficult to produce the color deepening effect without the loss of luster. Moreover, it cannot be easily applied to blended fabrics.

On the other hand, the methods described in said Japanese patent also leave some problems yet to be solved. The plasma treatment for ordinary synthetic fibers, or synthetic fibers containing no fine particles, improves the color development performance to a certain extent, which is not wholly satisfactory. Moreover, the plasma treatment is economically disadvantageous because it takes a long time to perform.

There is also known other techniques for producing the color deepening effect by coating the fiber surface with a fluoropolymer or silicone polymer or by forming a thin layer of graft polymer on the fiber surface. However, such techniques suffer from a disadvantage that the polymer formed on the fiber surface impairs the hand of the fabric and causes poor adhesion to interlinings due to its inherently slippery properties and the coloring effect is limited.

SUMMARY OF THE INVENTION

It has been found in accordance with the present invention that when fibers having fine particles on the surface thereof are treated with plasma, the fine particles partially agglomerate to form projections, or the fine particles individually collect around the polymer base material constituting the fiber or the decomposition product thereof or other substances to form projections.

According to the present invention, the fine particles are more inert when exposed to low-temperature plasma as compared with the polymer base material constituting the fiber; the fine particles have an average primary particle diameter smaller than 0.5 micrometer; the fine particles are attached in an amount of 0.001 to 10 wt % based on the fiber or fibrous structure; and the fibrous structure thus prepared is treated with low-temperature plasma, whereby projections greater than the average primary particle diameter are formed.

The irregularities formed according to the process of this invention have such a structure that the average size of the projections is greater than 1.1 times, preferably 1.1 to 10 times, the average primary particle diameter and each projection is made up of one particle or two or more particles connected together.

DETAILED DESCRIPTION OF THE INVENTION

Figure 1:
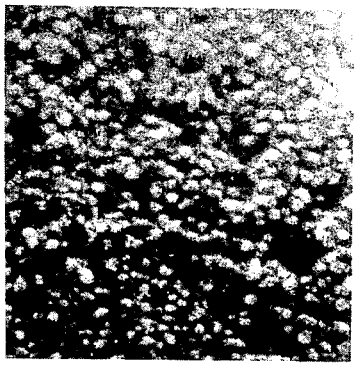

While not wishing to be bound by any theory or mechanism, it is currently believed that when a fiber surface covered with inert fine particles is treated with low-temperature plasma, the fine particles work as a shield against the plasma. Those parts not shielded by the fine particles undergo plasma etching. The fine particles remain with little change, or agglomerate. This agglomeration is caused by condensation of the vaporized polymer or other substances formed by plasma. Thus, the fine particles form projections which are larger than the fine particles.

The projections thus produced have an effect on the color development of dyed products. It was unexpectedly found that not only the configuration of the projections but also the configuration and area of the concave portions etched in the base material have a remarkable effect.

The irregularities were examined by means of electron photomicrographs of 60,000 magnification (60 mm to 1 micrometer) taken by a scanning electron microscope. Irregularities of such a structure that the distance between adjacent projections or concave portions is greater than 0.7 micrometer do not produce any significant effect. On the other hand, excessively minute irregularities impair the color development performance and change the color tone, making a black color to look like a dark blue color. In the case of such minute irregularities, the distance is less than 0.01 micrometer, which is undistinguishable in the electron photomicrograph. The distance from one concave part to an adjacent one is mostly 0.01 to 0.5 micrometer.

Examinations were made at different magnifications of 60,000, 12,000, 24,000 and 100,000; but the best results were obtained from electron photomicrographs of 60,000 magnifications. The following description is based thereon.

The projections and concave portions of the irregularities are distinguished by the shade in an electron photomicrograph. It was found that as the shade area (concave portions) decreases, the color development performance is greatly improved. If the area of concave portions is less than 0.1 $\mu m^2$ per 1 $\mu m^2$ of irregularities, the color development performance becomes rather poor. On the other hand, if it exceeds 0.8 $\mu m^2$, the effect of the fine particles is not produced. Thus, the area of the concave portions should be 0.15 to 0.76 $\mu m^2$, preferably 0.3 to 0.5 $\mu m^2$. The upper and lower limits vary depending on the type and size of the fine particles used.

Individual projections in the irregularities should contain fine particles whose average primary particle diamter is smaller than 0.5 micrometer. And the projections should be higher than 0.02 micrometer; otherwise, visually observable improvement is not made in the color development performance of dyed fabrics. Likewise, individual projections should have a minor axis of 0.03 to 0.7 micrometer as measured in the direction parallel to the fiber surface. The projections may exist separately or in conjunction with one another, or both. Fine particles of smaller diameter tend to form joined projections, and fine particles of larger diameter tend to form independent projections. The manner in which the projections are formed varies depending on the quantity of fine particles attached to the fiber. A good effect is produced if the irregularities are of such a structure that the concave portions are connected to one another.

The present invention provides fibrous textures which are greatly improved in luster, color depth, and color brilliance. The color deepening effect achieved by the invention is exceptionally superior to that achieved by the conventional technology. It was unexpectedly found that the fibrous texture of this invention has antistatic properties and flame retardance.

The process of this invention can be applied not only to synthetic fibers but also to natural fibers such as wool, cotton, flax, and silk, semi-synthetic fibers such as acetate, and regenerated fibers such as rayon. The synthetic fibers include polyester, polyamide, polyacrylic, polyurethane, and others, and copolymers and blends thereof, and composite fibers. They may contain a surface active agent, antioxidant, UV absorber, flame retardant, colorant, delustering agent, plasticizer, and antistatic agent.

The fibrous structure of this invention includes one which is formed by combining or mixing at least one or more of the above-mentioned fibers. Such a fibrous structure is not limited to tow, filament, and yarn in the linear form; but it includes knitted, woven, and nonwoven fabrics in flat form.

The same effect as mentioned above can be produced even in items in film form or coated items.

The process of this invention is accomplished by the steps of attaching fine particles to the surface of the fiber or a fibrous structure and then treating the fibrous structure with low-temperature plasma before or after dyeing.

It is important that the fine particles used in this invention be more inert than the polymer base material when the treatment with low-temperature plasma is carried out. Such fine particles are selected from silicon-containing inorganic particles, inorganic particles of an oxide and/or salt of the metal belonging to Group II of the Periodic Table, aluminum oxide, thorium oxide, and zirconium oxide. Where it is desirable to impart specific functional properties to the fibrous structure, fine particles of the following materials can be used. Tin oxide, antimony oxide, aluminum phosphate, and calcium phosphate for flame retardance; ferrite for electromagnetism; barium titanate for dielectric properties; and titanium oxide for ultraviolet shielding or abrasion resistance. Such particles can be used individually or in combination with one another.

The particles should have an average primary particle diameter smaller than 0.5 micron, preferably smaller than 0.2 micron, more preferably smaller than 0.07 micron. Most preferable among such particles is silica, because it has the lowest refractive index and the color deepening effect is affected by the refractive index. For good dispersibility, fine particles of a colloidal type are desirable, but not required.

The fine particles can be attached to the fiber surface in the same way as commonly used for application of other materials to resins. For example, a liquid in which the fine particles are dispersed is transferred to a fibrous structure by padding, spraying, or printing. The pick-up of the liquid is properly adjusted by using a mangle or the like, and the fibrous structure is treated with dry heat or wet heat.

Where it is desirable to attach the fine particles firmly to the fiber surface, an adhesive resin or a monomer thereof may be used simultaneously with or after the attaching of the fine particles. An adhesive resin in aqueous emulsion form is easy to use. It may be mixed with the colloidal fine particles unless coagulation takes place. Where colloidal silica is used as the fine particles, an anionic or nonionic resin emulsion is preferred. (A cationic resin emulsion tends to cause coagulation.) Needless to say, the mixture of the fine particles and the adhesive resin may be incorporated with an antistatic agent, flame retardant, antimelting agent, water-repellent, antisoiling finish, water absorbent finish, and other finishes. These finishes may be added to either the fine particles or the adhesive resin, where the adhesive resin is applied after the fine particles have been attached. These finishes improve the washability of the fibrous structure of this invention. It is considered that they are partly decomposed by plasma treatment but the decomposition products bond to the fine particles.

The minute irregularities formed by the fine particles and low-temperature plasma treatment provides a scrooping feeling and dry hand. Where a slippery feeling like that of wool is desirable, the objective is achieved by using a fluoropolymer or silicone polymer, and preferably by introducing a fluorine-containing compound or silane compound which is capable of free radical polymerization in the plasma or by applying them to the fiber after plasma treatment. In this manner, it is possible to impart a wool-like hand which is not excessively smooth but has a proper degree of slipperiness.

Another effective method of bonding the fine particles to the fiber is to apply an adhesive resin after the plasma treatment of the fiber to which the fine particles have been attached. In actual practice of this method, bonding is accomplished by the plasma polymerization of the adhesive resin. This method greatly improves the durability of the resulting fibrous structure. Moreover, this method has an advantage of being a dry process. The plasma polymerization can be carried out in two ways. In one way, a monomer is introduced after plasma etching, with radicals still remaining. In the other way, a monomer is introduced while electrical discharge is being made, after plasma etching. A preferred monomer for plasma polymerization is one which has a comparatively low boiling point and is volatile at normal temperature. Examples of such monomers include acrylic acid, methacrylic acid, esters thereof, silicon compounds, and fluorine compounds.

According to the process of this invention, the irregularities on the fiber surface are currently believed to be formed by the following mechanism. That part of the polymer base material which is not shielded by fine particles or finishes is scattered by the plasma and becomes the concave portions of the base material. The vaporized comoponents or the third components which are polymerizable in plasma bond together around the fine particles attached to the fiber surface. Thus projections larger than the fine particles are formed. If many irregularities of a certain magnitude are to be formed on the fiber surface, it is crucially important that as many fine particles as possible be present as uniformly as possible on the surface of the base material of fiber. Moreover, the fine particles should be distributed as thinly as possible; otherwise, etching is not sufficient to provide the desired hand. Therefore, the quantity of the fine particles should be 0.001 to 10 wt %, preferably 0.005 to 2 wt %, based on the weight of fiber. If the quantity of the fine particles is less than 0.001 wt %, the color development performance and the hand are improved only slightly, and if it exceeds 10%, the hand becomes very poor. This range may be greatly extended depending on the weight and denier of the fibrous structure.

Since the projections larger than the diameter of fine particles attached can be obtained according to the above-proposed mechanism, the substance that bonds to the fine particles is not limited to the above-mentioned thrrd substance. It is possible to use a substance which is applicable to chemical vapor deposition or physical vapor deposition. Such a substance includes polymers, inorganic substances, and metals which can undergo vacuum deposition, sputtering, and ion plating. In use, these substances are introduced into the plasma area, where they are vaporized and then deposited on the fine particles.

Plasma is defined as a gas containing approximately equal number of positive ions and negative ions or electrons along with neutral atoms. Such a gas is formed when a high energy is applied to a substance so that the molecules or atoms are dissociated. Usually, a low-temperature plasma is produced when a high voltage of low-frequency, high-frequency, or microwave is applied to a gas under reduced pressure of 10 Torr or less. The excited atoms, ions, and electrons in the plasma act on or etch the surface of the polymer base material. For the generation of low-temperature plasma, oxygen, air, nitrogen, argon, olefins, etc. are preferably used.

The treatment with low-temperature plasma should be carried out under varied conditions according to the material, composition, and configuration of the fiber to be treated and the desired degree of color depth. For proper treatment, it is necessary to select the type and configuration of the apparatus, the kind and flow rate of gas, the degree of vacuum, the output, and the treating time.

According to the process of this invention, the projections are formed by the substance which has accumulated on the fine particles, as mentioned above. Therefore, the process of this invention differs from the conventional process for forming irregularities on the fiber surface with plasma treatment without attaching fine particles to the fiber surface. So, the process of this invention does not require an intensive condition for plasma treatment. What is required is such a mild condition that the base fiber material is etched to a depth of about several microns. Plasma treatment under such a mild condition causes substances to accumulate on the fine particles and to form the desired irregularties.

The fibrous structure of this invention is not necessarily required to have surface irregularities all over the both sides. A structure having orifice irregularities on either side will do, depending on applications. In such a case, the fibers exposed on one side are provided with surface irregularities. This may be accomplished by selecting a proper plasma treatment condition.

It was found that the color deepening effect produced by low-temperature plasma treatment varies depending on the kind of gas used. For example, oxygen is best and air and argon follow. It was found that the gas flow rate greatly affects the etching rate under a given degree of vacuum.

The plasma treatment may be performed before or after the dyeing of the fiber; but the latter case is preferred because the irregularities formed on the fiber surface may be deformed by dyeing.

The process of this invention may be carried out, with the fibrous structure for plasma treatment partly covered with a proper covering material other than the above-mentioned fine particles. The covering provides a pattern or color which is distinctly different from that in the uncovered part or plasma-treated part. This practice imparts a unique effect to the dyed product.

The process of this invention may be applied to a fibrous structure made of fibers having a previously roughened surface. The surface roughening may be accomplished by etching polyester fibers containing fine particles with an alkaline solution, as disclosed in the known technology cited first in the above-foregoing. However, the process of this invention can be applied to any fibrous structure with the fiber surface roughened by other methods than mentioned above.

The process of this invention can impart an improved color depth to polyester fibers which, on dyeing, are poorest in color depth and brilliance among synthetic fibers. Thus the process of this invention produces the maximum effect when applied to polyester fibers.

The polyester as used herein means a polymer in which about 75% of the repeating units is the glycol dicarboxylate represented by the formula

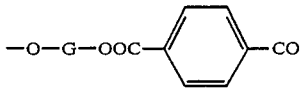

(wherein G is a divalent organic radical having 2 to 18 carbon atoms and being attached to adjacent oxygen atoms through a saturated carbon atom.) The repeating units may be composed entirely of terephthalate; but the repeating units may contain, up to about 25%, of other dicarboxylates such as adipate, sebacate, isophthalate, bibenzoate, hexahydroterephthalate, diphenoxyethane-4,4'-dicarboxylate, and 5-sulfoisophthalate. The glycol includes polymethylene glycols (e.g. ethylene glycol, tetramethylene glycol, and hexamethylene glycol), branched-chain glycols (e.g., 2,2-dimethyl-1,3-propanediol), diethylene glycol, triethylene glycol, and tetraethylene glycol, and a mixture thereof. The repeating units may also contain a higher glycol such as polyethylene glycol in an amount up to about 15 wt %.

The polyester may be incorporated with a delustering agent, luster improver, discoloration inhibitor, etc. as the occasion demands.

It will be undestood from the foregoing that the process of this invention is designed to change the fiber surface into one which has a special structure. Thus, it can be applied to any fibrous structure made of at least one or more natural fibers, regenerated fibers, and semi-synthetic fibers. It can also be applied to fibrous structures made of composite fiber of sheath-core structures or laminated structures.

Moreover, the process of this invention can be applied to fibrous structures made of fibers having a cross-section of pentagon, hexagon, polyfolious form (e.g., tri-, tetra-, penta-, hexa-, hepta-, and octa-folious form), or T-form. Such a cross-section is formed by false texturing, or by using a spinning nozzle having a contoured cross-section.

The process of this invention has the effect of reducing the glitter of false twist yarns; in other words, it produces a glitter-free effect when applied to the draw textured yarn of partially oriented yarn obtained by high-speed spinning.

The invention is described in more detail with reference to the following examples, which are illustrative only and are not intended to impose any limitations upon the scope of the invention.

As is known to those skilled in the art, it is a usual practice to incorporate titanium dioxide into polyester fibers for the purpose of delustering and to treat polyester fibers with an alkaline solution for the purpose of improving the hand of fibrous structure made thereof. Therefore, in the following examples and comparative examples, the fibrous structures made of polyester fibers to which the process of this invention is applied are ones which are made of semi-dull, treated polyester fibers. Needless to say, the process of this invention can also be applied to other fibrous structures.

EXAMPLE 1

Polyethylene terephthalate having an intrinsic viscosity [$\eta$] of 0.69 was prepared in the usual way. The polymer was made into a 75-denier yarn composed of 36 filaments, each having a round cross-section, by the ordinary spinning and stretching methods. The yarn was doubled to make a 150-denier yarn, and the doubled yarn underwent real twisting (S twist and Z twist) of 2100 turns per meter, followed by heat-setting. Then, the twisted yarns (as warp and weft) were woven into a "Chirimen" georgette. The fabric was creped and then underwent heat-setting. The fabric was treated with an aqueous solution of sodium hydroxide (40 g/liter) at 98° C. so that the fabric lost 25% of its weight. The fabric was dyed in black at 135° C. with 12% o.w.f. of Kayalon Polyester Black G-SF (a dye produced by Nippon Kayaku Co., Ltd.), combined with 0.5 g/l of Tohosalt TD (a dispersing agent produced by Toho Kagaku Co., Ltd.) and 0.7 g/l of Ultra Mt-$N_2$ (a pH adjuster composed of acetic acid and sodium acetate, produced by Daiwa Kagaku Kogyo Co., Ltd.). For reduction, the dyed fabric was treated with a solution containing hydrosulfite (1 g/l), sodium hydroxide (1 g/l), and non-ionic surface active agent (1 g/l), at 80° C. for 10 minutes, followed by rinsing. Thus there was obtained a black-dyed fabric.

Colloidal silica having an average primary particle diameter of 15 millimicrons was attached in various amounts to the black-dyed fabric by using the pad-dry method.

Each of the silica-carrying fabrics thus prepared was placed in a plasma apparatus of the internal electrode type, and was exposed to plasma for 1 to 5 minutes. The plasma was produced under the conditions of frequency: 110 KHz, degree of vacuum: 0.05 to 1 Torr, and output: 50 W. The plasma gas was oxygen or air. The color depth of the plasma-treated fabric was measured by a recording spectrophotometer made by Hitachi, Ltd. The color depth is expressed in terms of L* in the L*a*b* color space. The smaller the value L*, the greater the color depth.

The irregularities were examined by means of electron photomicrographs of 60,000 magnifications taken by a scanning electron microscope. Measurements were carried out for the surface area measuring 1 square micrometer at five places on the fiber surface. The results are shown in Table 1.

The L* value of the dyed Chirimen georgette measured before application of fine particles and plasma treatment was 15.2. After plasma treatment, without fine particles, the L* value decreased to 14.6, as shown in Experiment No. 1. It is to be noted that the L* value decreased remarkably when the fabrics underwent plasma treatment, with fine powder attached to their surface, as shown in Experiment No. 2 and on.

Figure 2:
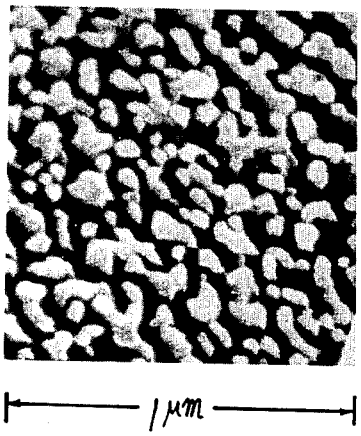

FIG. 1 is an electron photomicrograph (60,000 ×) of the fabric of Experiment No. 3 taken after the fine particles had been attached to the fabric. FIG. 2 is an electron photomicrograph (60,000 ×) of the same fabric as above taken after the fabric had undergone plasma treatment, with the fine particles attached to the surface thereof. It is noted from FIG. 2 that the projections formed by plasma treatment have a minor axis of about 0.02 to 0.1 micrometer and a major axis which is several times greater than the minor axis. In the photomicrograph, the lightly shaded parts represent the projections, and the densely shaded parts, the concave portions. The area of the concave portions in a given unit area is closely related to the color development performance. As it decreases, the degree of color depth increases. However, if the area of concave portions is smaller than 0.1 $\mu m^2$ per 1 $\mu m^2$ of irregularities, an adverse effect is produced. On the other hand, if the area of concave portions is excessively large, the color deepening effect is reduced. Thus a preferred limit is 0.8 $\mu m^2$ per 1 $\mu m^2$.

In Experiment No. 2, the distance between projections is in the range from 0.01 to 1.0 $\mu$m, which exceeds the range of 0.01 to 0.7 $\mu$m. Thus, the color deepening effect in No. 2 was poor. It is noted in No. 3 that as little silica as 0.001 wt % is sufficient to produce a good effect. When the quantity of fine particles is increased to 10 wt %, as in Experiment No. 10, the hand of the resulting fabric becomes unpracticably harsh.

ing effect is produced sufficiently even though the loading of fine particles is low. This may be cohvincingly elucidated by the fact that the number of fine particles is the same in both cases. However, when the particle diameter is excessively large, as in Experiment No. 23, the color deepening effect disappears and the fabric looks white due to scattered light. In Experiment No. 15, in which silica having a particle diameter of 0.045 $\mu$m was used but the loading was as low as 0.001 wt %, the color deepening effect was not satisfactory, because the number of fine particles is excessively.small and the area of concave parts is excessively large. Except Experiment Nos. 15, 20, and 23, the treated fabrics had a scrooping feeling and a silk-like hand.

TABLE 1

| Experiment No. | Loading of fine particles (wt %) | Degree of vacuum (Torr) | Plasma gas | Time of plasma treatment (min) | Value of L* | Minor axis of projection ($\mu$m) | Average size of projection | Distance between projections ($\mu$m) | Area of concave parts ($\mu m^2$) |
|---|---|---|---|---|---|---|---|---|---|
| 1 | — | 0.1 | $O_2$ | 1 | 14.6 | — | — | — | — |
| 2 | 0.0005 | 0.1 | $O_2$ | 1 | 14.0 | 0.020–0.10 | 1.3a–6.7a* | 0.01–1.0 | 0.765 |
| 3 | 0.001 | 0.1 | $O_2$ | 1 | 13.1 | 0.017–0.12 | 1.13a–8a | 0.01–0.15 | 0.554 |
| 4 | 0.005 | 0.1 | $O_2$ | 1 | 12.9 | 0.020–0.14 | 1.3a–9.3a | 0.01–0.13 | 0.509 |
| 5 | 0.01 | 0.1 | $O_2$ | 1 | 13.0 | 0.030–0.13 | 2a–8.7a | 0.01–0.1 | 0.448 |
| 6 | 0.05 | 0.1 | $O_2$ | 1 | 12.7 | 0.020–0.26 | 1.3a–17a | 0.01–0.13 | 0.454 |
| 7 | 0.1 | 0.1 | $O_2$ | 1 | 11.4 | 0.040–0.25 | 2.7a–16a | 0.01–0.10 | 0.427 |
| 8 | 1.0 | 0.1 | $O_2$ | 1 | 8.3 | 0.050–0.33 | 3.3a–22a | 0.01–0.08 | 0.396 |
| 9 | 2.0 | 0.1 | Air | 3 | 8.9 | 0.050–0.28 | 3.3a–18.7a | 0.01–0.09 | 0.399 |
| 10 | 10.0 | 0.1 | $O_2$ | 1 | 13.9 | 0.015–0.09 | 1a–6a | –0.02 | 0.093 |
| 11 | 0.01 | 0.05 | $O_2$ | 1 | 13.4 | 0.020–0.11 | 1.3a–7.3a | 0.01–0.43 | 0.615 |
| 12 | 0.01 | 0.01 | $O_2$ | 5 | 3.2 | 0.050–0.30 | 3.3a–20a | 0.01–0.1 | 0.176 |

*a: Average primary particle diameter

EXAMPLE 2

TABLE 2

| Experiment No. | Average primary particle diameter of silica ($\mu$m) | Loading of silica (wt %) | Value of L* | Minor axis of projection ($\mu$m) | Average size of projection | Distance between projections ($\mu$m) | Area of concave parts ($\mu m^2$) |
|---|---|---|---|---|---|---|---|
| 13 | a = 0.015 | 0.001 | 16.8 | 0.018–0.10 | 1.2a–6.7a | 0.01–0.19 | 0.547 |
| 14 | a = 0.015 | 0.01 | 16.7 | 0.03–0.12 | 2a–8a | 0.01–0.11 | 0.461 |
| 15 | a = 0.045 | 0.001 | 18.0 | 0.05–0.12 | 1.1a–2.7a | 0.1–1.0 | 0.910 |
| 16 | a = 0.045 | 0.01 | 15.7 | 0.04–0.10 | 0.9a–2.2a | 0.01–0.21 | 0.454 |
| 17 | a = 0.045 | 0.08 | 14.2 | 0.05–0.33 | 1.1a–7.3a | 0.02–0.09 | 0.396 |
| 18 | a = 0.045 | 0.35 | 12.9 | 0.05–0.15 | 1.1a–3.3a | 0.01–0.07 | 0.303 |
| 19 | a = 0.045 | 2.5 | 13.8 | 0.05–0.12 | 1.1a–2.7a | 0.01–0.06 | 0.273 |
| 20 | a = 0.045 | 4.0 | 16.3 | 0.05–0.11 | 1.1a–2.4a | 0.01–0.09 | 0.148 |
| 21 | a = 0.120 | 0.1 | 16.9 | 0.13–0.32 | 1.08a–2.7a | 0.03–0.4 | 0.529 |
| 22 | a = 0.5 | 0.1 | 17.6 | 0.3–0.95 | 0.6a–1.9a | 0.06–0.7 | 0.638 |
| 23 | a = 1.0 | 0.1 | 22.4 | 0.8–1.2 | 0.8a–1.2a | 0.5–3 | 0.870 |

After heat-setting, weight loss treatment with alkali, and dyeing in black, palace crepe made up of polyethylene terepthalate yarn (warp: 50 denier/36 filaments, weft: 75 denier/72 filaments) was provided with silica of different average primary particle diameter. The fabric was placed in a plasma apparatus of internal electrode type, and was exposed to plasma for 50 seconds. The plasma was produced under the conditions of frequency: 110 KHz, degree of vacuum: 0.15 Torr, and output: 0.37 kWh/$m^2$. The plasma gas was oxygen.

The color depth of the palace crepe measured before the loading of fine particles and the plasma treatment was L* = 18.9. Table 2 shows the color depth measured after the plasma treatment and the results of obervation of the plasma-treated surface under a scanning electron microscope. As Experixent Nos. 13, 14, 15, 16, 21, and 22 show, where fine particles of greater diameter are used, the color deepening effect becomes remarkable as the loading of fine particles is increased, and where fine particles of smaller diameter are used, the color deepen-

EXAMPLE 3

Black-dyed commercial woolen fabric, rayon/polyester blend fabric, and triacetate/polyester blend fabric were provided with 0.1 wt % of silica by the pad-dry method. The so treated fabrics underwent plasma treatment under the same conditions as Example 1. The color deepening effect was produced as shown in Table 3. Examination under a scanning electron microscope revealed that the fiber surface has such a structure that the concave portions account for 0.3 to 0.5 $\mu m^2$ in 1 $\mu m^2$ of the fiber surface, and the height of the projections was 0.04 to 0.16 $\mu$m.

The plasma-treated woolen fabric, which felt excessively harsh, was then treated with the vapor of $CH_2{=}CHCOOCH_2CF_2CF_2H$. This treatment imparted an antisoiling property and resistance to dry cleaning to the fabric. It was possible to treat the fabric by a series of dry processes.

TABLE 3

| Sample | Color depth (L*) of untreated fabric | Degree of vacuum (Torr) | Plasma gas | Time of plasma treatment (min) | L* after plasma treatment | Area of concave parts ($\mu m^2$) |
|---|---|---|---|---|---|---|
| Wool crepe georgette | 13.7 | 0.3 | air | 2 | 9.3 | 0.352 |
| Rayon/polyester blend Chirimen georgette | 14.2 | 0.3 | air | 2 | 10.2 | 0.461 |
| Triacetate/polyester blend crepe georgette | 13.9 | 0.3 | air | 2 | 9.9 | 0.411 |

EXAMPLE 4

A sample of 2/2 twill fabric of polyethylene terephthalate false twist yarn (150 denier/48 filaments) dyed in dark blue was provided with 2.0 wt % of aluminum hydroxide having an average primary particle diameter of 0.1 micrometer. The fabric underwent plasma treatment for 5 minutes in a plasma apparatus of the internal electrode type under the following conditions. Frequency: 13.56 KHz, plasma gas: argon, and degree of vacuum: 0.05 Torr. Subsequently, the fabric further underwent plasma treatment for 30 seconds, while chloromethyl dimethylchlorosilane gas was being introduced. The L* value measured before plasma treatment was 27, and it decreased to 22 after plasma treatment. On the other hand, the LOI (limiting oxygen index), which is an index of flame retardance, measured before plasma treatment was 21; and it increased to 24 after plasma treatment. After 50 times of washing, the static charge measured by a rotary static tester was 360 V in the case of plasma-treated fabric and 6000 V in the case of untreated fabric. This example gives a fabric which is superior in flame retardance, anti-static properties, and color depth.

EXAMPLE 5

Polyester fibers were produced, the fibers were woven into Chirimen georgettes, and the fabrics were treated with alkali and dyed in the same manner as in Example 1.

The polyester fibers were produced from the same polyethylene terephthalate compound as used in Example 1. The polyester fibers were also produced from silica-containing polyethylene terephthalate compound having an intrinsic viscosity [$\eta$] of 0.69. The latter compound was prepared by mixing at room temperature ethylene glycol with a 20 wt % aqueous silica sol having an average primary particle diameter of 45 millimicrons, and then mixing the ethylene glycol with terephthalic acid, followed by polymerization. The quantity of the aqueous silica sol was varied.

The fabric dyed in black was treated with plasma. Table 4 shows the effect of the quantity and type of fine particles attached to the fabric and the effect of the quantity of fine particles incorporated into the polymer.

The fabrics thus prepared were placed in a plasma apparatus of the internal electrode type, and were exposed to plasma for 1 to 5 minutes. The plasma was produced under the conditions of frequency: 110 KHz, degree of vacuum: 0.05 to 1 Torr, and output: 50 W. The plasma gas was oxygen or air.

It is noted in examples 5-1 to 5-4 that the smaller the average particle diameter of fine particles attached to the fabric, the lower the value L* or the better the color depth. It is also noted in examples 5-1 to 5-8 that the fine particles to be attached to the fabric should preferably be silica having a comparatively low refractive index.

Examples 5-9 to 5-14 show that the color deepening effect is produced when silica is incorporated into the polymer and the fiber produced from the polymer undergoes weight loss treatment with an alkali. As the quantity of silica is increased, the fiber surface is roughened more by the alkali treatment, and the color deepening effect is enhanced. The roughened, black-dyed fabric is further improved in color depth when it is covered with fine particles and treated with plasma.

Examination under a scanning electron microscope revealed that the fiber surface has such a structure that the distance between projections was in the range from 0.01 to 0.7 $\mu$m, and the concave portions account for 0.15 to 0.76 $\mu m^2$ in 1 $\mu m^2$ of the fiber surface, and the projections were higher than 0.02 m, and the average size of the projections after the plasma treatment was greater than 1.1a.

In Comparative Example 5-15, the fabric was treated with plasma, with no fine particles attached thereto. In this case, the fabric is improved in color depth to a certain extent because it is made of fibers containing 3% of fine particles and it has undergone the weight loss treatment with an alkali. It is to be noted, however, that value L* is not so decreased by plasma treatment as compared with that in the case of 5-12. The fabric in 5-12 is the same as that in 5-15, except that the former is covered with fine particles.

TABLE 4

| Example | 5-1 | 5-2 | 5-3 | 5-4 | 5-5 | 5-6 | 5-7 | 5-8 | 5-9 | 5-10 | 5-11 | 5-12 | 5-13 | 5-14 | 5-15* |
|---|---|---|---|---|---|---|---|---|---|---|---|---|---|---|---|
| Polymer | | | | | | | | | | | | | | | |
| Type of polymer | PET | PET | PET | PET | PET | PET | PET | PET | PET | PET | PET | PET | PET | PET | PET |
| Particles loaded | $TiO_2$ | $TiO_2$ | $TiO_2$ | $TiO_2$ | $TiO_2$ | $TiO_2$ | $TiO_2$ | $TiO_2$ | $SiO_2$ | $SiO_2$ | $SiO_2$ | $SiO_2$ | $SiO_2$ | $SiO_2$ | $SiO_2$ |
| Particle size (m$\mu$) | 200 | 200 | 200 | 200 | 200 | 200 | 200 | 200 | 45 | 45 | 45 | 45 | 45 | 45 | 45 |
| Loading (wt %) | 0.45 | 0.45 | 0.45 | 0.45 | 0.45 | 0.45 | 0.45 | 0.45 | 0.1 | 0.5 | 1.0 | 3.0 | 5.0 | 10.0 | 3.0 |
| Processing | | | | | | | | | | | | | | | |
| Fibrous texture | Chirimen georgette | | | | | | | | | | | | | | |
| Weight loss (%) | 25 | 25 | 25 | 25 | 25 | 25 | 25 | 25 | 25 | 25 | 25 | 25 | 25 | 25 | 25 |
| Dyeing color | Black | | | | | | | | | | | | | | |
| Color depth (L*) | 15.2 | 15.2 | 15.2 | 15.2 | 15.2 | 15.2 | 15.2 | 15.2 | 14.9 | 14.2 | 13.9 | 13.5 | 13.0 | 13.3 | 13.5 |
| Fine particles | $SiO_2$ | $SiO_2$ | $SiO_2$ | $SiO_2$ | $Al_2O_3$ | $TiO_2$ | $CaCO_3$ | $CaCO_3$ | $SiO_2$ | $SiO_2$ | $SiO_2$ | $SiO_2$ | $SiO_2$ | $SiO_2$ | $SiO_2$ |
| Particle size (m$\mu$) | 15 | 45 | 70 | 200 | 200 | 200 | 100 | 500 | 45 | 45 | 45 | 45 | 45 | 45 | 45 |
| Loading (wt %) | 0.8 | 0.8 | 0.8 | 0.8 | 0.8 | 0.8 | 0.8 | 0.8 | 0.5 | 0.5 | 0.5 | 0.5 | 0.5 | 0.5 | 0.5 |

TABLE 4-continued

| Example | 5-1 | 5-2 | 5-3 | 5-4 | 5-5 | 5-6 | 5-7 | 5-8 | 5-9 | 5-10 | 5-11 | 5-12 | 5-13 | 5-14 | 5-15* |
|---|---|---|---|---|---|---|---|---|---|---|---|---|---|---|---|
| Adhesive resin | — | — | — | — | — | — | — | — | — | — | — | — | — | — | — |
| Loading (wt %) | — | — | — | — | — | — | — | — | — | — | — | — | — | — | — |
| Plasma treatment | | | | | | | | | | | | | | | |
| Plasma gas | $O_2$ | $O_2$ | $O_2$ | $O_2$ | $O_2$ | $O_2$ | $O_2$ | $O_2$ | $O_2$ | $O_2$ | $O_2$ | $O_2$ | $O_2$ | $O_2$ | $O_2$ |
| Vacuum (Torr) | 0.08 | 0.08 | 0.08 | 0.08 | 0.08 | 0.08 | 0.08 | 0.08 | 0.08 | 0.08 | 0.08 | 0.08 | 0.08 | 0.08 | 0.08 |
| Output (W) | 50 | 50 | 50 | 50 | 50 | 50 | 50 | 50 | 50 | 50 | 50 | 50 | 50 | 50 | 50 |
| Time (min) | 2 | 2 | 2 | 2 | 2 | 2 | 2 | 2 | 2 | 2 | 2 | 2 | 2 | 2 | 2 |
| Resin or monomer | — | — | — | — | — | — | — | — | — | — | — | — | — | — | — |
| Process | — | — | — | — | — | — | — | — | — | — | — | — | — | — | — |
| Resin loading (wt %) | — | — | — | — | — | — | — | — | — | — | — | — | — | — | — |
| Color depth (L*) | 9.3 | 9.5 | 10.0 | 11.0 | 12.3 | 13.0 | 12.8 | 13.3 | 9.4 | 9.0 | 8.6 | 8.0 | 7.8 | 8.2 | 11.5 |

*Comparative Example

EXAMPLE 6

The examples as shown in Table 5 are intended to demonstrate that the process of this invention can be applied to fabrics dyed in any color other than black or dyed with two or more colors.

The value L* is a lightness index for black color, and the lower the lightness, the more black the black color. In the case of other colors than black, the saturation indicates the brilliance of the color. However, unlike the value L*, the brilliance cannot be reliably expressed in numerical values. Thus the brilliance of color was rated as follows by visual observation in these examples.

A: Great (better than silk)
B: Medium
C: Small

The scrooping feeling was also qualitatively rated by handling as follows:

A: Great (better than silk)
B: Medium
C: Small

Polyethylene terephthalate was produced in the same manner as in Example 5. The polymer was made into drawn yarn of 50 denier/36 filaments and 75 denier/36 filaments in the usual way. The drawn yarn was made into plain Habutae, twill Habutae, palace, Yoryu and chiffon. They underwent weight loss treatment with an alkali. The thus prepared fibrous structures were then treated with plasma in the following manner.

The plasma apparatus used was the same one as in Example 5.

6-1 to 6-4 show that the effect of this invention cannot be produced by plasma treatment alone or by the attaching of fine particles alone; a satisfactory effect can be produced only when the fabric undergoes plasma treatment, with fine particles attached to the surface thereof.

The plain Habutae obtained in 6-4 was much better in luster and color than those obtained in 6-1 to 6-3. It was even better than silk due to a superior scrooping feeling and puffiness.

The plain Habutae in 6-5 was produced from the same polymer as used in 5-12 and 5-15. It underwent weight loss treatment but did not undergo plasma treatment. It took on a dark color but lacked luster.

In 6-6, the fine particles were firmly bonded to the fiber surface by the aid of modified polyvinyl alcohol. The Habutae obtained in this example was superior in durability of luster, color, and hand after washing.

The twill Habutae obtained in 6-8 to 6-10 was superior in luster and color brilliance to that in 6-7. In addition it gave a better hand than silk on account of a strong scrooping feeling. The fabrics obtained in 6-9 and 6-10, in which methyl methoxysilane and $C_2F_4$ gas were polymerized by plasma, respectively, were superior in washability to that obtained in 6-8. Their luster, color, and hand remained unchanged after washing which was repeated 50 times. The fabric obtained in 6-9 was endowed with hydrophilic property and the fabric obtained in 6-10 was endowed with water repellency.

Palace, Yoryu, and chiffon produced in 6-12 to 6-14 according to this invention took on a glossy, brilliant color and gave a scrooping feeling which do not make one regard them as polyester.

On examination under a scanning electron microscope, on a structure of the fiber surface, it was observed that the distance between projections was in the range for 0.01 to 0.7 $\mu$m, and the concave portions account for 0.15 to 0.76 $\mu m^2$ in 1 $\mu m^2$ of the fiber surface, and the average size of the projections after the plasma treatment was greater than 1.1a.

TABLE 5

| Example | 6-1* | 6-2* | 6-3* | 6-4 | 6-5* | 6-6* | 6-7* | 6-8 | 6-9 | 6-10 | 6-11* | 6-12 | 6-13 | 6-14 |
|---|---|---|---|---|---|---|---|---|---|---|---|---|---|---|
| Polymer | | | | | | | | | | | | | | |
| Type of polymer | PET | PET | PET | PET | PET | PET | PET | PET | PET | PET | PET | PET | PET | PET |
| Particles loaded | $TiO_2$ | $TiO_2$ | $TiO_2$ | $TiO_2$ | $SiO_2$ | $TiO_2$ | $TiO_2$ | $TiO_2$ | $TiO_2$ | $TiO_2$ | $TiO_2$ | $TiO_2$ | $TiO_2$ | $TiO_2$ |
| Particle size (m$\mu$) | 200 | 200 | 200 | 200 | 45 | 200 | 200 | 200 | 200 | 200 | 200 | 200 | 200 | 200 |
| Loading (wt %) | 0.08 | 0.08 | 0.08 | 0.08 | 3.0 | 0.08 | 0.08 | 0.08 | 0.08 | 0.08 | 0.08 | 0.08 | 0.08 | 0.08 |
| Processing | | | | | | | | | | | | | | |
| Fibrous texture | | | Plain Habutae | | | | | Twill Habutae | | | Palace | Palace | Yoryu | Chiffon |
| Weight loss (%) | 25 | 25 | 25 | 25 | 25 | 25 | 25 | 25 | 25 | 25 | 25 | 25 | 25 | 25 |
| Dyeing color | Print | Print | Print | Print | Print | Print | Print | Print | Print | Print | Dark blue | Dark blue | Red | Blue |
| Color brilliance | C | C | C | C | B | C | C | C | C | C | C | C | C | C |
| scrooping feeling | C | C | C | C | B | C | C | C | C | C | C | C | C | C |
| Fine particles | — | — | $SiO_2$ | $SiO_2$ | — | $SiO_2$ | — | $SiO_2$ | $SiO_2$ | $SiO_2$ | — | $SiO_2$ | $SiO_2$ | $SiO_2$ |
| Particle size (m$\mu$) | — | — | 15 | 15 | — | 15 | — | 45 | 45 | 45 | — | 70 | 45 | 45 |
| Loading (wt %) | — | — | 0.3 | 0.3 | — | 0.3 | — | 0.3 | 0.3 | 0.3 | — | 0.7 | 0.5 | 0.5 |
| Adhesive resin | — | — | — | — | — | PVA | — | — | — | — | — | — | — | — |
| Loading (wt %) | — | — | — | — | — | 0.2 | — | — | — | — | — | — | — | — |

TABLE 5-continued

| Example | 6-1* | 6-2* | 6-3* | 6-4 | 6-5* | 6-6* | 6-7* | 6-8 | 6-9 | 6-10 | 6-11* | 6-12 | 6-13 | 6-14 |
|---|---|---|---|---|---|---|---|---|---|---|---|---|---|---|
| Plasma treatment | | | | | | | | | | | | | | |
| Plasma gas | — | $O_2$ | — | $O_2$ | — | $O_2$ | $O_2$ | $O_2$ | $O_2$ | $O_2$ | $O_2$ | $O_2$ | $O_2$ | $O_2$ |
| Vacuum (Torr) | — | 0.05 | — | 0.05 | — | 0.05 | 0.05 | 0.05 | 0.05 | 0.05 | 0.05 | 0.05 | 0.05 | 0.05 |
| Output (W) | — | 50 | — | 50 | — | 50 | 50 | 50 | 50 | 50 | 50 | 50 | 50 | 50 |
| Time (min) | — | 1 | — | 1 | — | 1 | 1 | 1 | 1 | 1 | 1 | 1 | 1 | 1 |
| Resin or monomer | — | — | — | — | — | — | — | — | (a) | (b) | — | — | — | — |
| Process | — | — | — | — | — | — | — | — | (c) | (c) | — | — | — | — |
| Resin loading (wt %) | — | — | — | — | — | — | — | — | 0.1 | 0.2 | — | — | — | — |
| Color brilliance | C | B–C | B–C | A | B | A | B–C | A | A | A | B–C | A | A | A |
| scrooping feeling | C | B–C | B–C | A | B | A | B–C | A | A | A | B–C | A | A | A |

*Comparative Examples
Note to Table 5.
(a) Methyl trimethoxysilane
(b) $C_2F_4$
(c) Plasma polymerization

EXAMPLE 7

The examples as shown in Table 6 are intended to demonstrate the effect of the process of this invention which is produced when the type of the fibrous structure is changed or the kind of the fiber material constituting the fibrous structure is changed.

In 7-1 to 7-4, the same polymer as used in Example 5 was made into drawn yarn of 100 denier/48 filaments by the usual spinning method. After false twisting, the yarn was made into cashmere doeskin fabric and tromat fabric. It is noted that the fabrics in 7-2 and 7-4 which underwent plasma treatment, with fine particles attached thereto, had a lower value L* than those in 7-1 and 7-3 which underwent plasma treatment, with fine particles not attached thereto. They were also low in the degree of glitter and had a good color depth of black. They were superior to woolen fabrics.

In 7-5 to 7-8, polybutylene terephthalate or nylon was made into drawn yarn of 40 denier/24 filaments, and the yarn was made into tricot knitting fabrics. The fabrics in 7-6 and 7-8 were superior in luster and brilliance to those in 7-5 and 7-7. They looked like a product of high class.

In 7-9 to 7-10, polybutylene terephthalate copolymerized with 2.5 mol % of sulfoisophthalic acid was made into drawn yarn of 50 denier/36 filaments, and the yarn was made into satin weaves. The weave in 7-10 was superior in luster and brilliance to that in 7-9. It had a favorable hand and scrooping feeling, but had no waxy hand which is characteristic to melt-spun fibers, and it also has a hand like silk.

In 7-11 and 7-12, the same polyethylene terephthalate as used in 7-1 to 7-4 was made into drawn yarn of 75 denier/36 filaments. After false twisting, the drawn yarn was made into knit velours in the usual way. It is noted that the fabrics in 7-12 which underwent plasma treatment, with fine particles attached thereto, took on a darker black color than that in 7-11 which underwent plasma treatment, with fine particles not attached thereto.

On examination under a scanning electron microscope, it was found that the fiber which did not undergo the plasma treatment according to this invention has surface irregularities having a corrugated pattern that extends in the direction perpendicular to the axis of the fiber, whereas the fiber which underwent the plasma treatment according to this invention has surface irregularities in random directions, and the irregularities have such a structure that the distance from one projection to an adjacent one is 0.01 to 0.7 micron, and the concave portions account for 0.15 to 0.76 $\mu m^2$ in 1 $\mu m^2$ of the fiber surface, and the average size of the projections after the plasma treatment is greater 1.1a.

TABLE 6

| Example | 7-1* | 7-2 | 7-3* | 7-4 | 7-5* | 7-6 | 7-7* | 7-8 | 7-9* | 7-10 | 7-11* | 7-12 |
|---|---|---|---|---|---|---|---|---|---|---|---|---|
| Polymer | | | | | | | | | | | | |
| Type of polymer | PET | PET | PET | PET | PBT | PBT | Nylon | Nylon | Copoly PET | Copoly PET | PET | PET |
| Particles loaded | $TiO_2$ | $TiO_2$ | $TiO_2$ | $TiO_2$ | $TiO_2$ | $TiO_2$ | $TiO_2$ | $TiO_2$ | $TiO_2$ | $TiO_2$ | $TiO_2$ | $TiO_2$ |
| Particle size (mμ) | 200 | 200 | 200 | 200 | 200 | 200 | 200 | 200 | 200 | 200 | 200 | 200 |
| Loading (wt %) | 0.45 | 0.45 | 0.45 | 0.45 | 0.03 | 0.03 | 0.3 | 0.3 | 0.3 | 0.3 | 0.08 | 0.08 |
| Processing | | | | | | | | | | | | |
| Fibrous texture | Cashmere doeskin | | Tromat | | Tricot | | | | Satin | Satin | Knit Velours | Knit Velours |
| Weight loss (%) | — | — | — | — | — | — | — | — | 15 | 15 | — | — |
| Dyeing color | Black | Black | Black | Black | Dark blue | Dark blue | Red | Red | Green | Green | Black | Black |
| L* or brilliance | 17.9 | 17.9 | 18.5 | 18.5 | 21.0 | 21.0 | B–C | B–C | B–C | B–C | 8.1 | 8.1 |
| scrooping feeling | — | — | — | — | — | — | — | | C | C | — | — |
| Fine particles | — | $SiO_2$ | — | $SiO_2$ | — | $SiO_2$ | — | $SiO_2$ | — | $SiO_2$ | — | $SiO_2$ |
| Particle size (mμ) | — | 70 | — | 70 | — | 70 | — | 70 | — | 15 | — | 15 |
| Loading (wt %) | — | 0.007 | — | 0.007 | — | 0.007 | — | 0.007 | — | 0.007 | — | 0.007 |
| Adhesive resin | — | — | — | — | — | — | — | — | — | — | — | — |
| Loading (wt %) | — | — | — | — | — | — | — | — | — | — | — | — |
| Plasma treatment | | | | | | | | | | | | |
| Plasma gas | air | air | air | air | air | air | air | air | air | air | air | air |
| Vacuum (Torr) | 0.12 | 0.12 | 0.12 | 0.12 | 0.12 | 0.12 | 0.12 | 0.12 | 0.12 | 0.12 | 0.12 | 0.12 |
| Output (W) | 70 | 70 | 70 | 70 | 70 | 70 | 70 | 70 | 70 | 70 | 70 | 70 |
| Time (min) | 1 | 1 | 1 | 1 | 1 | 1 | 1 | 1 | 1 | 1 | 1 | 1 |
| Resin or monomer | — | — | — | — | — | — | — | — | — | — | — | — |
| Process | — | — | — | — | — | — | — | — | — | — | — | — |

TABLE 6-continued

| Example | 7-1* | 7-2 | 7-3* | 7-4 | 7-5* | 7-6 | 7-7* | 7-8 | 7-9* | 7-10 | 7-11* | 7-12 |
|---|---|---|---|---|---|---|---|---|---|---|---|---|
| Resin loading (wt %) | — | — | — | — | — | — | — | — | — | — | — | — |
| L* or brilliance | 17.3 | 15.0 | 17.8 | 15.7 | 19.5 | 17.2 | B | A | B | A | 7.7 | 6.5 |
| scrooping Feeling | — | — | — | — | — | — | — | — | B | A | — | — |

*Comparative Examples

What is claimed is:

1. A fibrous structure having a roughened surface formed by projections containing fine particles and concave portions therebetween, wherein at least the surface layer of the fibers has irregularities therein whose structure is such that the distance between the adjacent projections is 0.01 to 0.7 micrometer and the total area of the concave portions is 0.1 to 0.8 square micrometer in 1 square micrometer of the irregularities.

2. A fibrous structure having a roughened surface as recited in claim 1, wherein the fine particles contained in the projections on the fiber surface have an average primary particle diameter smaller than 0.5 micrometer, the height of the projections is greater than 0.02 micrometer, the minor axis of the projections in the direction parallel to the fiber surface is greater than 0.03 micrometer, the projections are present individually or in conjunction with one another, and the projections are connected through the concave portions formed among them.

* * * * *